US010041446B2

(12) United States Patent
Xue

(10) Patent No.: US 10,041,446 B2
(45) Date of Patent: Aug. 7, 2018

(54) CARBURETOR WITH ROTARY VALVE

(71) Applicant: Meiying Xue, Hangzhou (CN)

(72) Inventor: Meiying Xue, Hangzhou (CN)

( * ) Notice: Subject to any disclaimer, the term of this patent is extended or adjusted under 35 U.S.C. 154(b) by 149 days.

(21) Appl. No.: 15/340,472

(22) Filed: Nov. 1, 2016

(65) Prior Publication Data

US 2017/0122261 A1 May 4, 2017

(30) Foreign Application Priority Data

Nov. 2, 2015 (CN) ..... 2015 2 0862067 U
Nov. 9, 2015 (CN) ..... 2015 2 0894319 U

(51) Int. Cl.

| | |
|---|---|
| ***F02M 3/00*** | (2006.01) |
| ***F02M 7/00*** | (2006.01) |
| ***F02M 9/00*** | (2006.01) |
| ***B01F 3/04*** | (2006.01) |
| ***F02M 1/04*** | (2006.01) |
| ***F02M 3/10*** | (2006.01) |
| ***F02M 9/10*** | (2006.01) |
| ***F02M 7/06*** | (2006.01) |
| ***F02M 9/08*** | (2006.01) |
| ***F02M 19/04*** | (2006.01) |

(52) U.S. Cl.

CPC ..... *F02M 1/043* (2013.01); *B01F 3/04* (2013.01); *F02M 3/10* (2013.01); *F02M 7/06* (2013.01); *F02M 9/08* (2013.01); *F02M 9/10* (2013.01); *F02M 19/04* (2013.01)

(58) Field of Classification Search

CPC ... B01F 3/04; F02M 7/06; F02M 3/10; F02M 9/08; F02M 19/04

USPC ..... 261/35, 44.6, 44.8, 69.1, DIG. 38

See application file for complete search history.

(56) References Cited

U.S. PATENT DOCUMENTS 7,290,757 B2 * 11/2007 Horikawa ..... F02M 9/08 261/44.6

* cited by examiner

*Primary Examiner* — Robert A Hopkins
(74) *Attorney, Agent, or Firm* — Shimokaji IP

(57) ABSTRACT

A carburetor with rotary valve includes an idle adjustment needle with an eccentric hole, accordingly a special adjustment tool used for idle adjustment needle has an eccentric boss; a carburetor with rotary valve includes an idle adjustment needle with an eccentric boss, accordingly a special adjustment tool used for idle adjustment needle has an eccentric hole. The idle adjustment needle must be cooperated with the special adjustment tool to carry out the adjustment, thus non-professional user can not casually adjust the fuel oil needle without the special tool, so that the engine can be maintained in the best setting condition to ensure the engine exhaust to meet the environmental protection requirement.

20 Claims, 10 Drawing Sheets

CARBURETOR WITH ROTARY VALVE

RELATED APPLICATIONS

This application claims the benefits of Chinese Patent Application No. 201520862067.6, filed on Nov. 2, 2015, and Chinese Patent Application No. 201520894319.3, filed on Nov. 9, 2015, the entire contents of which are hereby incorporated by reference in this application.

FIELD OF THE INVENTION

The present invention relates to a carburetor, and more particularly to a carburetor with rotary valve.

BACKGROUND OF THE INVENTION

Conventional carburetors are equipments that mix the proportional gasoline with air in a vacuum condition generated by an engine so as to supply mixed gas to the engine. The carburetor is called as a heart of the engine due to its significant function. The carburetor includes a start-up device, an idling device and a throttle control device, etc., and the carburetor can automatically prepare the desired mixed gas accordingly to different working status of the engine and output the mixed gas, further, the carburetor may atomize the fuel oil to make sure the uniformity of the mixed gas.

For maintaining the stable operation for the carburetor in the best proportion of fuel oil and air, the manufacturer will adjust the mixture proportion of the fuel oil and air when carburetor is made. In such a way, the carburetor can exert its best operation performance to extend its normal using lifetime and significantly save fuel oil resource. Thus it's necessary to configure a structure to prevent non-professional user from casually adjusting the mixture proportion of the fuel oil and the air on the carburetor. However, the conventional carburetor could not make it. For example, a carburetor with rotary valve has an idle needle with a head, and a steel ball is configured above the head, however, this structure is complicated and the manufacturer could not adjust the idle needle if the technical parameters of the carburetor are required to regulate.

SUMMARY OF THE INVENTION

For overcoming the drawing backs of the conventional carburetor, the present invention provides an improved carburetor with rotary valve. The carburetor includes a body, and the body is provided with a rotary valve hole in which a rotary valve is installed, a main needle sleeve is installed on an upper portion of the rotary valve, an idle adjustment needle is configured in the main needle sleeve, the idle adjustment needle comprises a first head, and an eccentric hole is provided on an end the first head.

Accordingly, the present invention provides a special adjustment tool used for the carburetor with rotary valve, which includes a handle and a head, a counterbore is provided on a front end of the head, and a first eccentric boss is provided with a bottom of the counterbore.

The present invention provides an improved carburetor with rotary valve. The carburetor includes a body, and the body is provided with a rotary valve hole in which a rotary valve is installed, a main needle sleeve is installed on an upper portion of the rotary valve, an idle adjustment needle is configured in the main needle sleeve, the idle adjustment needle comprises a second head, and a second eccentric boss is provided on an end the second head.

Accordingly, the present invention provides a special adjustment tool used for the carburetor with rotary valve, which includes a handle and a head, a concentric blind hole is provided on a front end of the head, and an eccentric counterbore is provided with a bottom of the concentric blind hole.

Preferably, the body is provided with an air intake passage, a mixing passage and a fuel-air mixture outlet passage.

Preferably, a rotary frame is configured between the rotary valve and the main needle sleeve.

Preferably, the main needle sleeve is provided with a first external thread portion, a smooth hole, a first internal thread portion and a recess.

Preferably, the body is provided with a pressure pulse passage and a pressure pulse chamber, an oil pump cover is installed on a lower end of the body, a film is configured between the lower end of the body and the oil pump cover, a sealed chamber is formed between the pressure pulse chamber and the film, and the pressure pulse passage is communicated with the pressure pulse chamber.

Preferably, the idle adjustment needle is connected with the first head by means of interference fit, and the idle adjustment needle is a polished rod.

Preferably, the first head is provided with a second external thread portion.

Preferably, an end of the first head that is opposite to the eccentric hole is provided with a concentric blind hole.

Preferably, a sealed sleeve is installed in the main needle sleeve.

Preferably, an outer wall of the sealed sleeve is a polished rod, and an inner wall of the sealed sleeve is an inner hole.

Preferably, a recess portion is provided on the main needle sleeve, and a cutout is formed in an inner wall of the recess portion.

Preferably, the cutout is in a V-shape structure.

In comparison with the prior art, on one hand, the idle adjustment needle with eccentric hole must be cooperated with the special adjustment tool with eccentric boss to carry out the adjustment, thus non-professional user can not casually adjust the fuel oil needle without the special tool, so that the engine can be maintained in the best setting condition to ensure the engine exhaust to meet the environmental protection requirements; on the other hand, the idle adjustment needle with eccentric boss must be cooperated with the special adjustment tool with eccentric hole to carry out the adjustment, thus non-professional user can not casually adjust the fuel oil needle without the special tool, so that the engine can be maintained in the best setting condition to ensure the engine exhaust to meet the environmental protection requirement.

DETAILED DESCRIPTION OF ILLUSTRATED EMBODIMENTS

Figure 1:
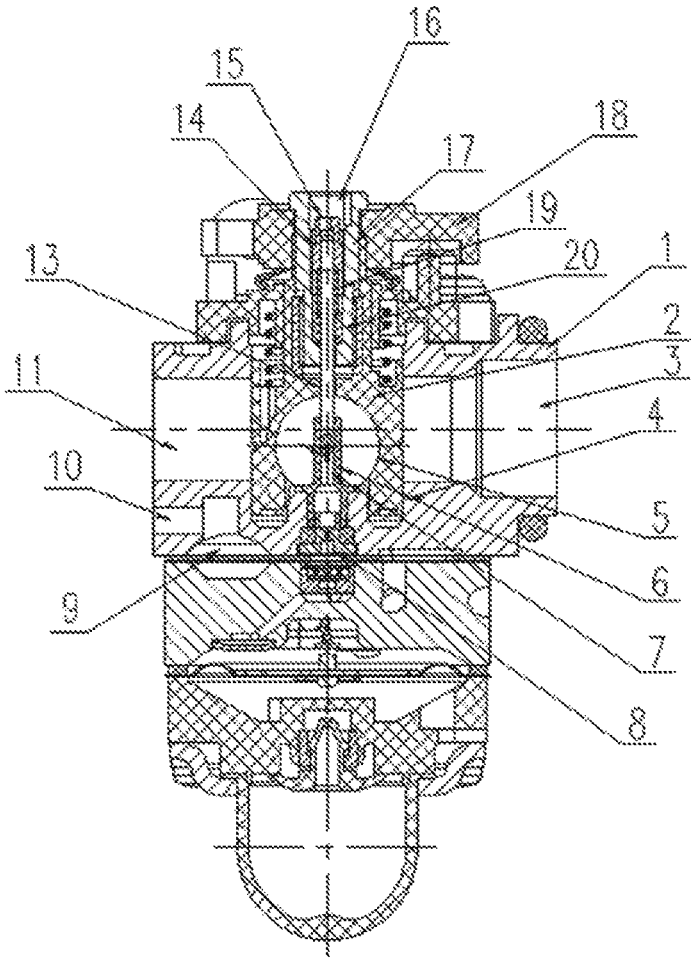
FIG. 1 is a sectional view of the carburetor with rotary valve according to a preferable embodiment, showing that the rotary valve is in idle position, and the idle adjustment needle has an eccentric hole.
Figure 2:
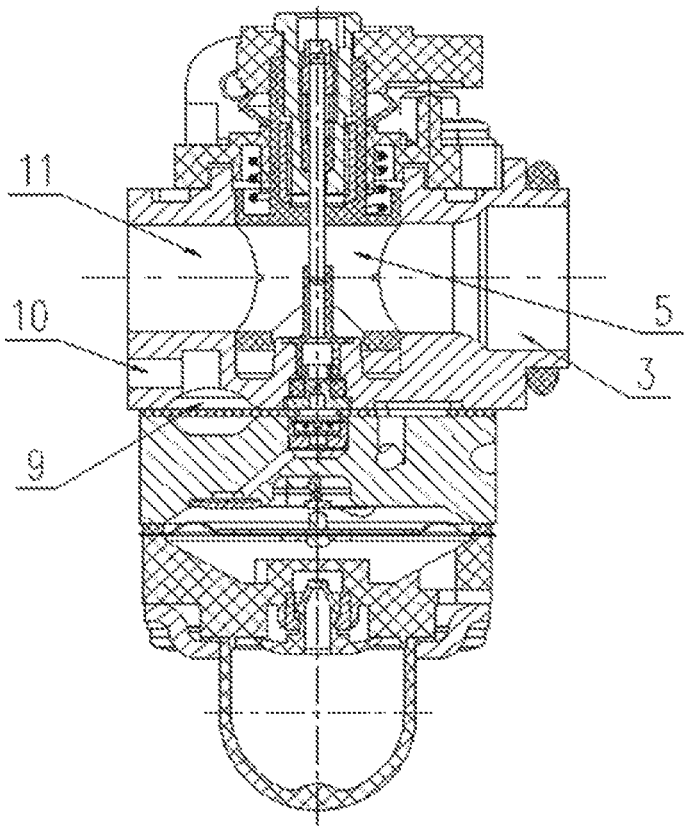
FIG. 2 is a sectional view of the carburetor with rotary valve according to a preferable embodiment, showing that the rotary valve is in full-load position, and the idle adjustment needle has an eccentric hole.

In order to understand the technical solution of the present invention, explanatory embodiments of the present invention and their features and advantages will now be described with reference to the Figures, wherein like reference numerals designate similar parts throughout the various views.

Embodiment 1

Figure 6:
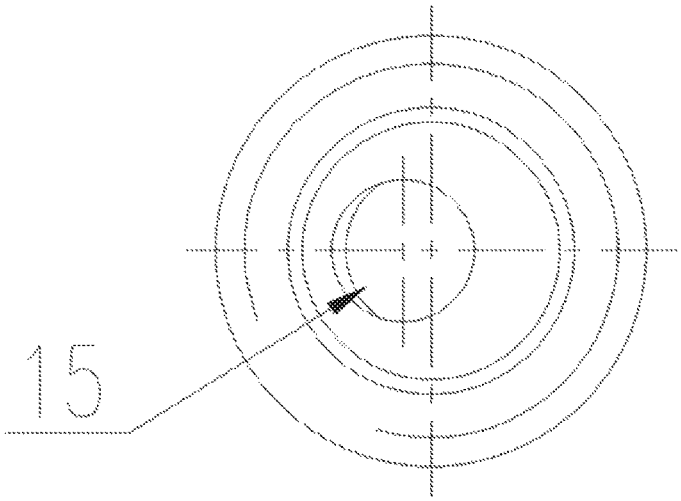
FIG. 6 is a top view showing the assembly of the idle adjustment needle and the head of the idle adjustment needle according to the carburetor with rotary valve shown in FIG. 1.
Figure 7:
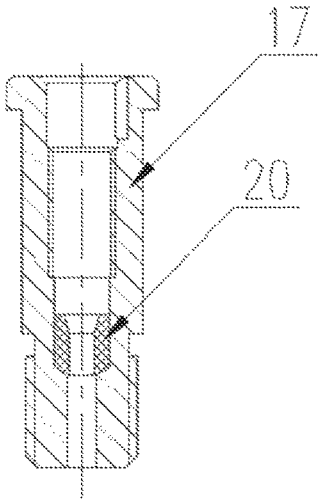
FIG. 7 is a sectional view showing the assembly of the main needle sleeve and the sealed sleeve according to the carburetor with rotary valve shown in FIG. 1.
Figure 8:
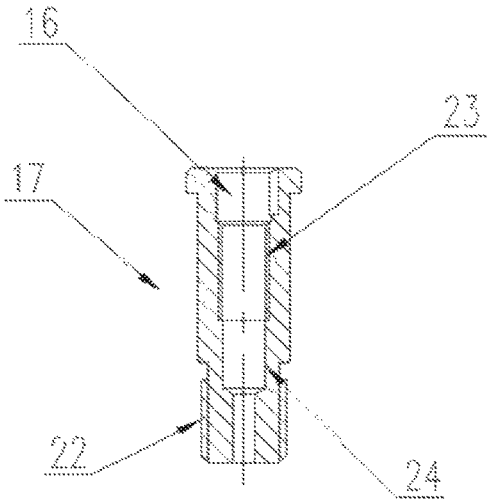
FIG. 8 is a sectional view of the main needle sleeve according to the carburetor with rotary valve in FIG. 1.

Referring to FIGS. 1-10, a carburetor with rotary valve includes a body 1, the body 1 is provided with a rotary valve hole 4 in which a rotary valve 2 is installed, a main needle sleeve 17 is installed on an upper portion of the rotary valve 2, and an idle adjustment needle 13 is configured in the main needle sleeve 17. Specifically, the idle adjustment needle 13 includes a first head 14, and an eccentric hole 15 is provided on an end the first head 14. As illustrated, the body 1 includes an air intake passage 3, a mixing passage 5 and a fuel-air mixture outlet passage 11. A rotary frame 18 is configured between the rotary valve 2 and the main needle sleeve 17. As shown in FIG. 8, the main needle sleeve 17 is provided with a first external thread portion 22, a smooth hole 24, a first internal thread portion 23 and a recess 16. The body 1 has a pressure pulse passage 10 and a pressure pulse chamber 9, an oil pump cover is mounted on a lower end of the body 1, a film is configured between the lower end of the body 1 and the oil pump cover, a sealed chamber is formed between the pressure pulse chamber 9 and the film, and the pressure pulse passage 10 is communicated with the pressure pulse chamber 9. Specifically, the idle adjustment needle 13 is connected with the first head 14 by means of interference fit, and the idle adjustment needle 13 is a polished rod. The first head 14 is provided with a second external thread portion 21, and another end of the first head 14 that is opposite to the eccentric hole 15 is provided with a concentric blind hole. A sealed sleeve 20 is configured in the main needle sleeve 17, an outer wall of the sealed sleeve 20 is a polished rod portion 25, and an inner wall of the sealed sleeve 20 is an inner hole 26, a recess portion (not labeled) is provided on the main needle sleeve 17, and a cutout is formed in an inner wall of the recess portion, preferably, the cutout is in a V-shape structure.

As shown in FIG. 1, the rotary valve 2 is connected with the rotary frame 18 by means of the main needle sleeve 17. A smooth hole 24 of the main needle sleeve 17 is connected with the sealed sleeve 20 by interface fit, the first internal thread portion 23 is connected with the second external thread portion 21, and by means of the special tool, the idle adjustment needle can be adjusted up and down, along the axis of the rotary valve 2, accordingly, the size of the main jet 7 can be adjusted, thereby finally adjusting the oil amount into the engine.

Figure 3:
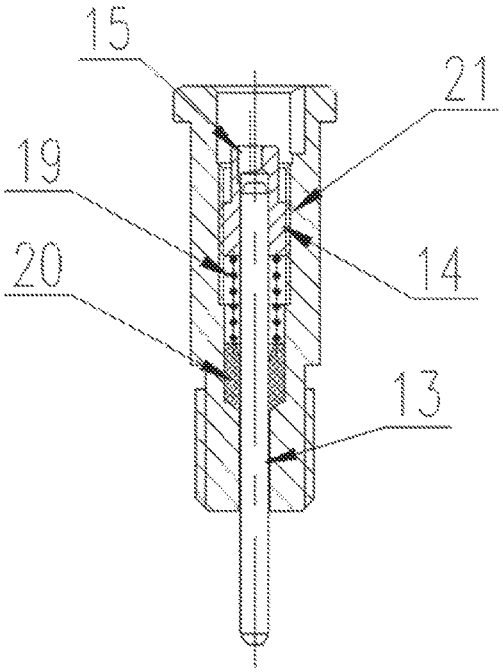
FIG. 3 is a sectional view showing the assembly of the idle adjustment needle and the main needle sleeve according to the carburetor with rotary valve in FIG. 1.
Figure 4:
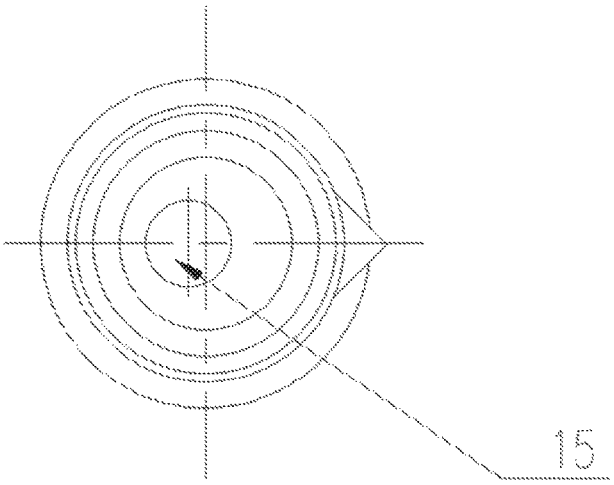
FIG. 4 is a top view showing the assembly of the idle adjustment needle and the main needle sleeve according to the carburetor with rotary valve shown in FIG. 1.

As shown in FIG. 3, the polished rod portion of the idle adjustment needle 13 runs through the sealed sleeve 20, and the first internal thread portion 23 is connected with the second external thread portion 21 by means of thread fit.

Figure 5:
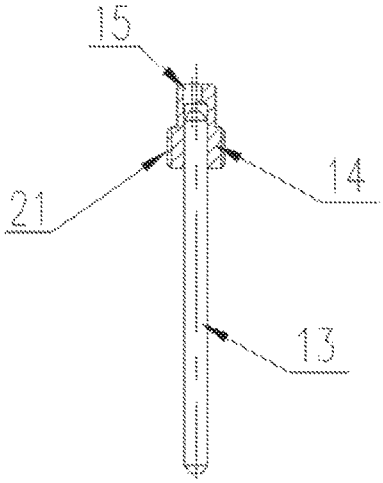
FIG. 5 is a sectional view showing the assembly of the idle adjustment needle and the head of the idle adjustment needle according to the carburetor with rotary valve shown in FIG. 1.

As shown in FIG. 5 and FIG. 6, the idle adjustment needle 13 is connected with the first head 14 by means of interface fit, and the first head 14 is formed with the external thread that is cooperated with the main needle sleeve 17. A concentric hole is formed on the end of the first head 14 for connecting with the idle adjustment needle 13, and the other end of the first head 14 is the adjustment end which includes an outer cylindrical surface and an end surface, and the eccentric hole 15 is formed on the end surface.

Figure 9:
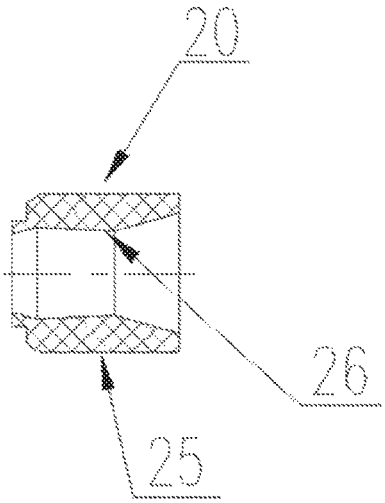
FIG. 9 is a sectional view of the sealed sleeve according to the carburetor with rotary valve in FIG. 1.
Figure 10:
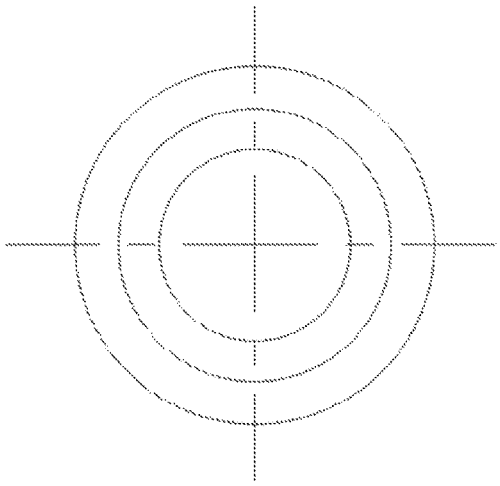
FIG. 10 is a right view of the sealed sleeve according to the carburetor with rotary valve in FIG. 1.

As shown in FIG. 7 and FIG. 9, the polished rod portion 25 of the sealed sleeve 20 is connected with the hole portion 24 of the main needle sleeve 17 by means of the interface fit, and furthermore the inner hole 26 is cooperated with the polished rod portion 25, the sealed sleeve 20 and the idle adjustment needle 13 are in a close and tight fit, in order to ensure the tightness and the sealing.

Figure 11:
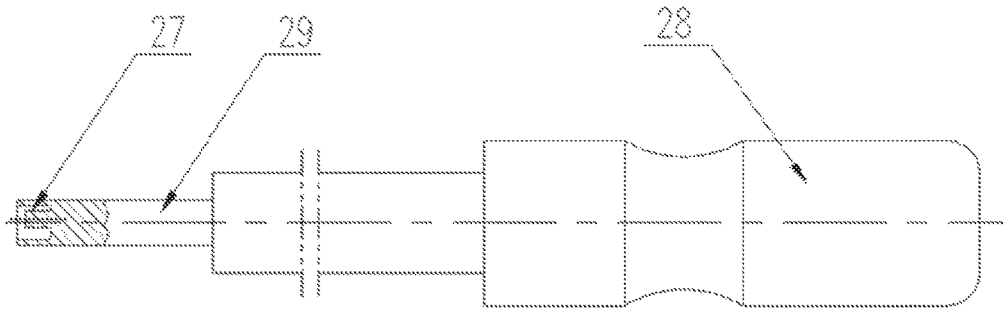
FIG. 11 is a front view of a special adjustment tool used for the carburetor with rotary shown in FIG. 1.
Figure 12:
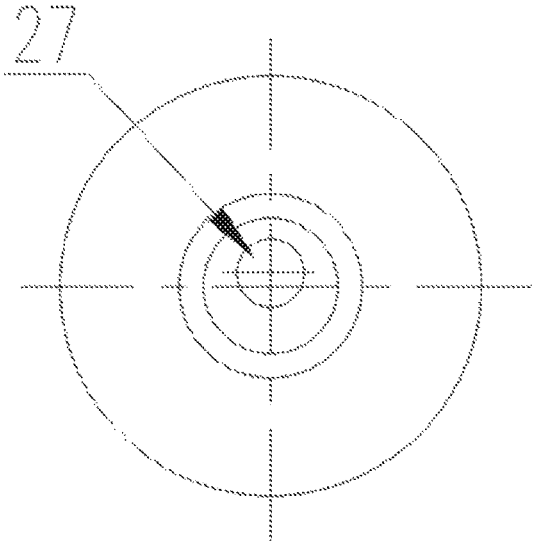
FIG. 12 is a left view of a special adjustment tool used for the carburetor with rotary shown in FIG. 1.
Figure 13:
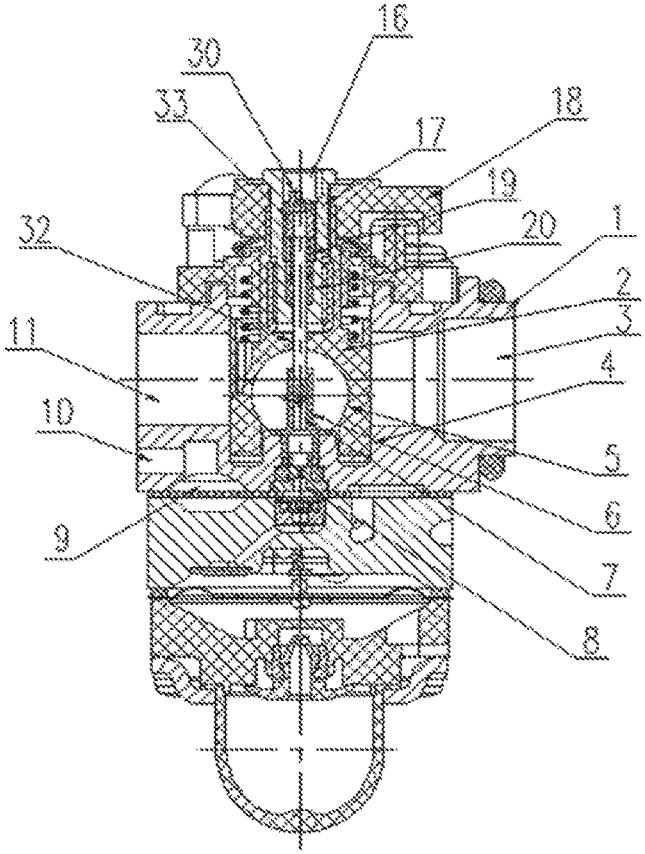
FIG. 13 is a sectional view of the carburetor with rotary valve according to a preferable embodiment, showing that the rotary valve is in idle position, and the idle adjustment needle has an eccentric boss.
Figure 14:
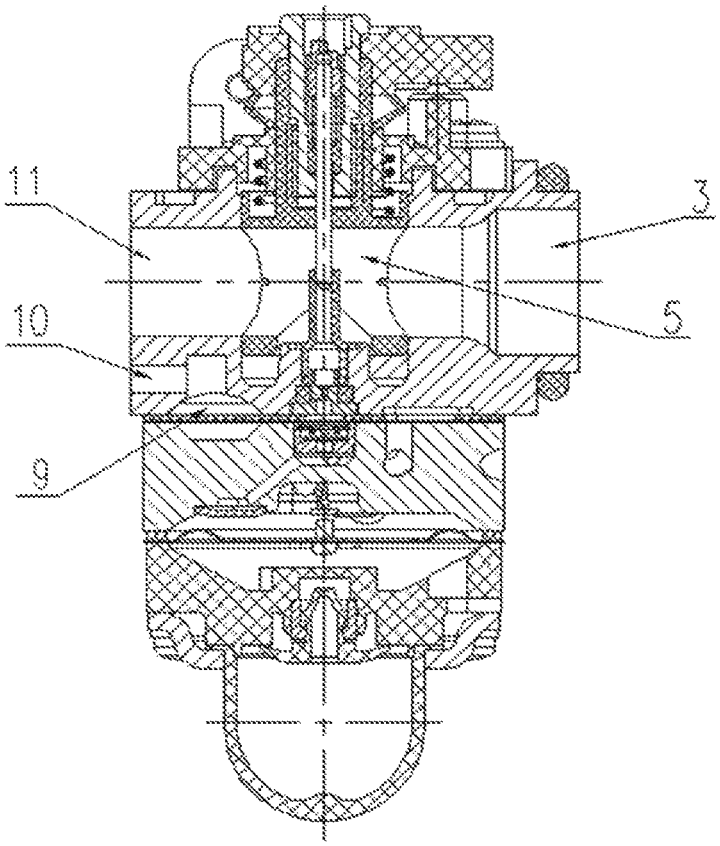
FIG. 14 is a sectional view of the carburetor with rotary valve according to a preferable embodiment, showing that the rotary valve is in full-load position, and the idle adjustment needle has an eccentric boss.

As shown in FIG. 11 and FIG. 12, a special adjustment tool used for the carburetor with rotary valve includes a handle 28 and a head 29, a counterbore is provided on a front end of the head 29, and a first eccentric boss 27 is provided with a bottom of the counterbore. The head 29 is a polished rod, and the first eccentric boss 27 is cooperated with the eccentric hole 15 thereby adjusting the idle adjustment needle 13.

Embodiment 2

Referring to FIGS. 13-18, a carburetor with rotary valve includes a body 1, the body 1 is provided with a rotary valve hole 4 in which a rotary valve 2 is installed, a main needle sleeve 17 is installed on an upper portion of the rotary valve 2, and an idle adjustment needle 32 is configured in the main needle sleeve 17. Specifically, the idle adjustment needle 32 includes a second head 14, and a second eccentric boss 33 is provided on an end the second head 14. As illustrated, the body 1 includes an air intake passage 3, a mixing passage 5 and a fuel-air mixture outlet passage 11. A rotary frame 18 is configured between the rotary valve 2 and the main needle sleeve 17. As shown in FIG. 8, the main needle sleeve 17 is provided with a first external thread portion 22, a smooth hole 24, a first internal thread portion 23 and a recess 16. The body 1 has a pressure pulse passage 10 and a pressure pulse chamber 9, an oil pump cover is mounted on a lower end of the body 1, a film is configured between the lower end of the body 1 and the oil pump cover, a sealed chamber is formed between the pressure pulse chamber 9 and the film, and the pressure pulse passage 10 is communicated with the pressure pulse chamber 9. A sealed sleeve 20 is configured in the main needle sleeve 17, an outer wall of the sealed sleeve 20 is a polished rod portion 25, and an inner wall of the sealed sleeve 20 is an inner hole 26, a recess portion (not labeled) is provided on the main needle sleeve 17, and a cutout is formed in an inner wall of the recess portion, preferably, the cutout is in a V-shape structure.

Figure 19:
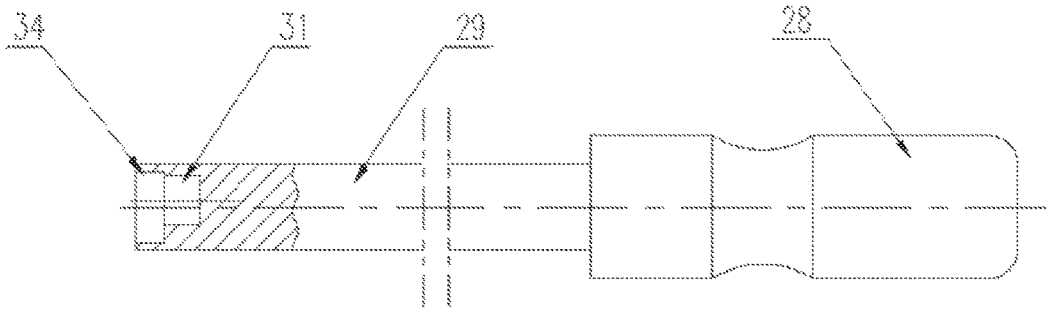
FIG. 19 is a left view of a special adjustment tool used for the carburetor with rotary shown in FIG. 13.

As shown in FIG. 19, the rotary valve 2 is connected with the rotary frame 18 by means of the main needle sleeve 17. A smooth hole 24 of the main needle sleeve 17 is connected with the sealed sleeve 20 by means of interface fit, the first internal thread portion 23 is connected with the second external thread portion 21, and by means of a special adjustment tool, the idle adjustment needle 32 can be adjusted up and down, along the axis of the rotary valve 2, accordingly, the size of the main jet 7 can be adjusted, thereby finally adjusting the oil amount into the engine.

Figure 15:
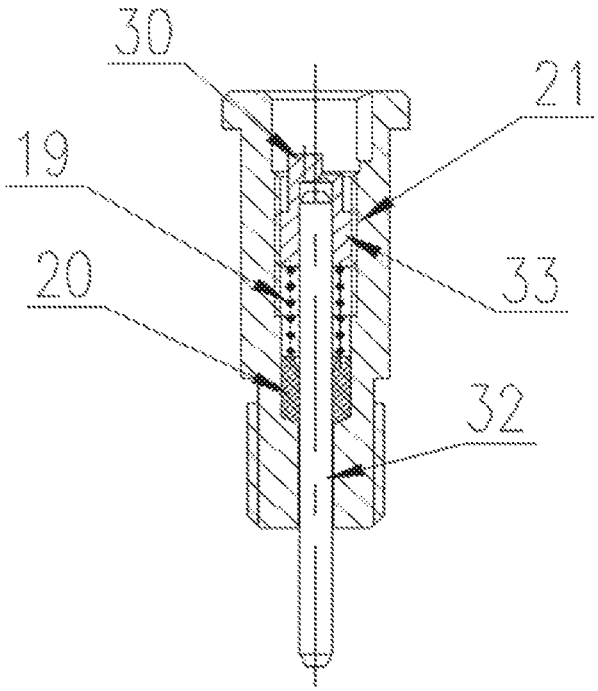
FIG. 15 is a sectional view showing the assembly of the idle adjustment needle and the main needle sleeve according to the carburetor with rotary valve in FIG. 13.
Figure 16:
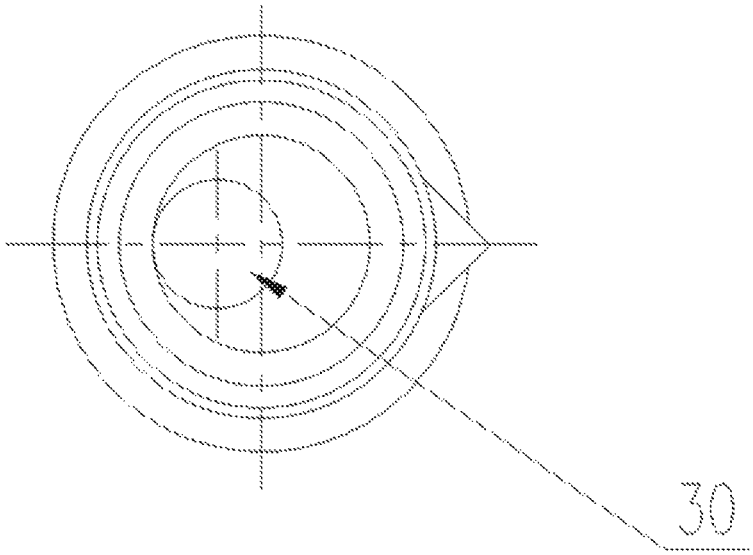
FIG. 16 is a top view showing the assembly of the idle adjustment needle and the main needle sleeve according to the carburetor with rotary valve shown in FIG. 13.

As shown in FIG. 15, the polished rod portion of the idle adjustment needle 32 runs through the sealed sleeve 20, and the first internal thread portion 23 is connected with the second external thread portion 21 by means of thread fit.

Figure 17:
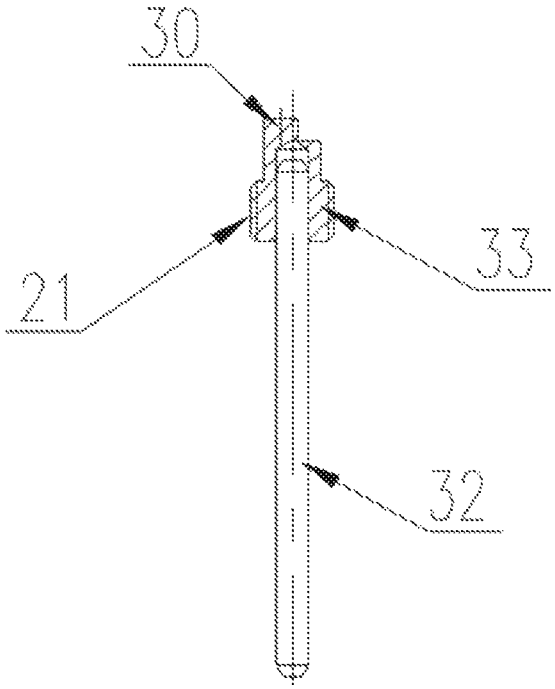
FIG. 17 is a sectional view showing the assembly of the idle adjustment needle and the head of the idle adjustment needle according to the carburetor with rotary valve shown in FIG. 13.
Figure 18:
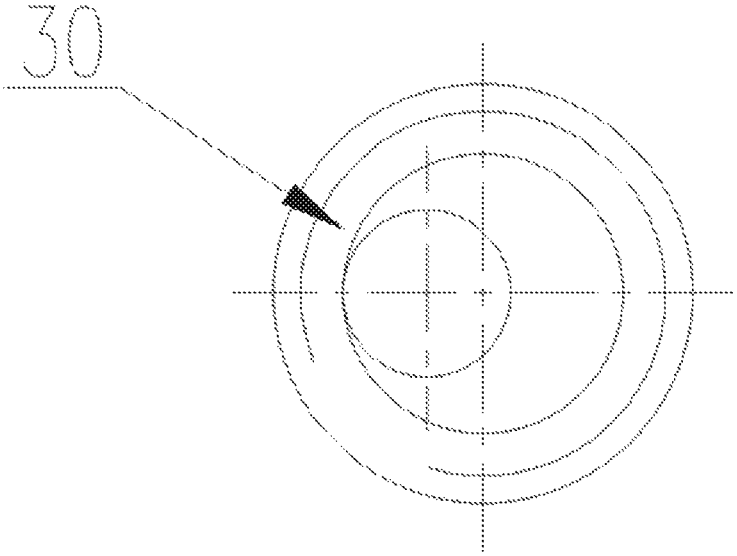
FIG. 18 is a top view showing the assembly of the idle adjustment needle and the head of the idle adjustment needle according to the carburetor with rotary valve shown in FIG. 13.

As shown in FIG. 17 and FIG. 18, the idle adjustment needle 32 is connected with the second head 33 by means of interface fit, and the second head 33 provided with the external thread that is cooperated with the main needle sleeve 17. A concentric hole is formed on the end of the second head 33 for connecting with the idle adjustment needle 32, and the other end of the second head 33 is the adjustment end which includes an outer cylindrical surface and an end surface, and the second eccentric boss 30 is formed on the end surface.

As shown in FIG. 7 and FIG. 9, the polished rod portion 25 of the sealed sleeve 20 is connected with the hole portion 24 of the main needle sleeve 17 by means of the interface fit, and furthermore the inner hole 26 is cooperated with the polished rod portion 25, the sealed sleeve 20 and the idle adjustment needle 32 are in a close and tight fit, in order to ensure the tightness and the sealing.

Figure 20:
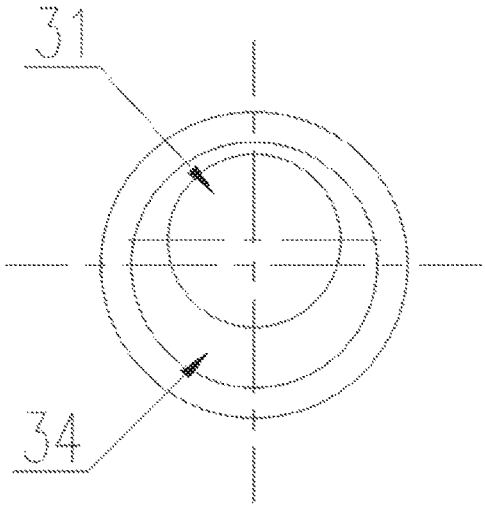
FIG. 20 is a front view of a special adjustment tool used for the carburetor with rotary shown in FIG. 13.

As shown in FIG. 19 and FIG. 20, a special adjustment tool used for the carburetor with rotary valve includes a handle 28 and a head 29, a concentric blind hole 34 is provided on a front end of the head 29, and an eccentric counterbore 31 is provided with a bottom of the counterbore. The head 29 is a polished rod, and the eccentric counterbore 31 is cooperated with the eccentric boss 33 thereby adjusting the idle adjustment needle 32.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A carburetor with rotary valve, comprising a body, wherein the body is provided with a rotary valve hole in which a rotary valve is installed, a main needle sleeve is installed on an upper portion of the rotary valve, an idle adjustment needle is configured in the main needle sleeve, the idle adjustment needle comprises a first head, and an eccentric hole is provided on an end the first head.

2. A special adjustment tool used for the carburetor with rotary valve according to claim 1, comprising a handle and a head, wherein a counterbore is provided on a front end of the head, and a first eccentric boss is provided with a bottom of the counterbore.

3. The carburetor with rotary valve according to claim 1, wherein the body is provided with an air intake passage, a mixing passage and a fuel-air mixture outlet passage.

4. The carburetor with rotary valve according to claim 1, wherein a rotary frame is configured between the rotary valve and the main needle sleeve.

5. The carburetor with rotary valve according to claim 1, wherein the main needle sleeve is provided with a first external thread portion, a smooth hole, a first internal thread portion and a recess.

6. The carburetor with rotary valve according to claim 1, wherein the body is provided with a pressure pulse passage and a pressure pulse chamber, an oil pump cover is installed on a lower end of the body, a film is configured between the lower end of the body and the oil pump cover, a sealed chamber is formed between the pressure pulse chamber and the film, and the pressure pulse passage is communicated with the pressure pulse chamber.

7. The carburetor with rotary valve according to claim 1, wherein the idle adjustment needle is connected with the first head by means of interference fit, and the idle adjustment needle is a polished rod.

8. The carburetor with rotary valve according to claim 1, wherein the first head is provided with a second external thread portion.

9. The carburetor with rotary valve according to claim 1, wherein an end of the first head that is opposite to the eccentric hole is provided with a concentric blind hole.

10. The carburetor with rotary valve according to claim 1, wherein a sealed sleeve is installed in the main needle sleeve.

11. The carburetor with rotary valve according to claim 10, wherein an outer wall of the sealed sleeve is a polished rod, and an inner wall of the sealed sleeve is an inner hole.

12. The carburetor with rotary valve according to claim 1, wherein a recess portion is provided on the main needle sleeve, and a cutout is formed in an inner wall of the recess portion.

13. The carburetor with rotary valve according to claim 12, wherein the cutout is in a V-shape structure.

14. A carburetor with rotary valve, comprising a body, wherein the body is provided with a rotary valve hole in which a rotary valve is installed, a main needle sleeve is installed on an upper portion of the rotary valve, an idle adjustment needle is configured in the main needle sleeve, the idle adjustment needle comprises a second head, and a second eccentric boss is provided on an end the second head.

15. A special adjustment tool used for the carburetor with rotary valve according to claim 14, comprising a handle and a head, wherein a concentric blind hole is provided on a front end of the head, and an eccentric counterbore is provided with a bottom of the concentric blind hole.

16. The carburetor with rotary valve according to claim 14, wherein the body is provided with an air intake passage, a mixing passage and a fuel-air mixture outlet passage.

17. The carburetor with rotary valve according to claim 14, wherein a rotary frame is configured between the rotary valve and the main needle sleeve.

18. The carburetor with rotary valve according to claim 14, wherein the main needle sleeve is provided with a first external thread portion, a smooth hole, a first internal thread portion and a recess.

19. The carburetor with rotary valve according to claim 14, wherein the body is provided with a pressure pulse passage and a pressure pulse chamber, an oil pump cover is installed on a lower end of the body, a film is configured between the lower end of the body and the oil pump cover, a sealed chamber is formed between the pressure pulse chamber and the film, and the pressure pulse passage is communicated with the pressure pulse chamber.

20. The carburetor with rotary valve according to claim 14, wherein a sealed sleeve is installed in the main needle sleeve.

* * * * *